United States Patent [19]

Wittmann et al.

[11] 4,288,095

[45] Sep. 8, 1981

[54] SAFETY SKI BINDING

[75] Inventors: Heinz Wittmann; Alois Himmetsberger, both of Vienna, Austria

[73] Assignee: TMC Corporation, Baar, Switzerland

[21] Appl. No.: 73,059

[22] Filed: Sep. 6, 1979

[30] Foreign Application Priority Data

Sep. 8, 1978 [AT] Austria ..... 6522/78

[51] Int. Cl.[3] ..... A63C 9/10

[52] U.S. Cl. ..... 280/625; 280/629

[58] Field of Search ..... 280/625, 629, 630

[56] References Cited

U.S. PATENT DOCUMENTS 3,850,438 11/1974 Sittmann ..... 280/629

4,166,636 9/1979 Svoboda et al. ..... 280/625

FOREIGN PATENT DOCUMENTS 2702468 7/1977 Fed. Rep. of Germany ..... 280/625

*Primary Examiner*—Joseph F. Peters, Jr.

*Assistant Examiner*—Milton L. Smith

*Attorney, Agent, or Firm*—Blanchard, Flynn, Thiel, Boutell & Tanis

[57] ABSTRACT

A toe jaw for a safety ski binding having a ski boot sole hold-down mechanism which is pivotal about an axis extending generally perpendicular with respect to a base plate secured to the upper surface of a ski. A support part is provided on the hold-down mechanism and is adapted to engage the frontmost portion of the sole of the ski boot. The support part is pivotal about an axis to accommodate a movement of the ski boot away from the toe jaw upon a release of the ski boot from the ski. The spring force utilizable for returning the sole holder to the original position is the same spring force which effects a returning of the support part to the original position thereof.

7 Claims, 7 Drawing Figures

SAFETY SKI BINDING

FIELD OF THE INVENTION

The invention relates to a safety ski binding, in particular a front jaw, having a hold-down means and which is pivotal about an axis, which is positioned at least in the position of use of the binding substantially perpendicular with respect to the base plate, in which for the lateral support of the ski boot there are provided two sole holders which can be moved against the force of a spring and are preferably constructed as two-armed levers.

BACKGROUND OF THE INVENTION

A safety ski binding of the above-mentioned type is described approximately in Austrian Pat. No. 270, 467. In this conventional construction, the support part is designed in connection with or resting on each arm of the two toggle levers of the front jaw, wherein a spring acts onto the arms of the toggle levers, which is supported on the support part and the support part is provided at least with a guideway for receiving one of the arms of the toggle levers. To return the toggle lever, which is moved or rather swung out during a release operation and serves as a sole holder, and thus the one of the support part, a spring must be used. If a spring is not provided, then after a release operation has been performed, the ski binding must be moved by hand into the initial position, which operation is complicated and is no longer affordable in view of the requirements of today, which requirements are made with respect to comfort on safety ski bindings.

A front jaw with a spring-loaded support member for the two sole holders and for a hold-down means is for example known from Austrian Pat. No. 315,041 (corresponds to U.S. Pat. No. 3,822,071). In this conventional construction, both the two sole holders and also the hold-down means are controlled by one single support member, which is constructed as a rotary member, wherein in each case one of the lever arms engages a rotating groove of the rotary member. Due to the fact that the hold-down means opens simultaneously with one of the sole holders, the release of the ski boot occurs in the vertical direction already at the start of the release operation, namely within the elasticity limit, wherein a release is not to take place, when the forces which act from outside are reduced. Since the resulting force, which starts the release operation, mostly brings about a twisting fall, the sole region of the ski boot adjacent the tip of the ski boot, is removed from the ski, if the upwardly opening hold-down means permits such a movement. Due to this removal, it is possible for snow, ice or the like to penetrate during the started fall between the upper surface of the ski and the underside of the ski boot sole, which makes a satisfactory closing of the binding more difficult, possibly is even prevented, if the release operation is terminated within the elasticity range, and downhill skiing is to be continued.

A different known front jaw, in which the two sole holders which are constructed as two-armed levers are designed independently from the hold-down means, is described for example in the Austrian Pat. No. 326,013 (corresponding to U.S. Pat. No. 3,854,741). This hold-down means is held during a lateral release operation of the ski boot in its base or initial position, which causes the upper surface of the ski boot which is in the tip area to rub on the underside of the hold-down means. Such frictional forces are undesired.

It is furthermore known from Austrian Pat. No. 272,908 to use a so-called stop surface to support the tip of the ski boot. Said stop surface is, however, a part of the entire stop member, which can be pivoted about an axis which is positioned substantially perpendicularly with respect to the upper surface of the ski against a resilient ball lock. The two sole holders are thereby at the same time constructed as a hold-down means, so that a separate hold-down means, as was mentioned above, is missing in this front jaw. Therefore, one can take from this reference in relationship to the subject matter of the invention only the knowledge of a stop surface for the tip of the ski boot. A further development of a stop surface for the support of the ski boot sole in the tip region of the ski boot is described in German OS No. 22 54 522 (corresponding to U.S. Pat. No. 3,910,592) in a form which is adjustable in longitudinal direction of the ski. Also this structural part, which is identified as a stop and which is screwed as a screw into the center web of a ski-fixed support part, thus represents during a release operation an additional frictional surface for the sole of the ski boot.

The purpose of the invention is now to provide in a safety ski binding, in particular in a front jaw, of the type mentioned in the beginning a support which is improved with respect to the frictional characteristic for the ski boot sole which is provided in the tip region of the ski boot and also to simplify the automatic return of the hold-down means.

Due to the fact that a support part which is associated with the hold-down means and can be swung together with same is provided for supporting the sole of the ski boot which is provided in the tip region of the ski boot, the support part follows the direction of the release of the ski boot, so that the occurring frictional forces are reduced. The hold-down means is thereby inventively freely swingable by a spring force, so that the entire ski binding construction can be simply manufactured and also less expensively. Also wear appearance on a separate spring thus do no longer occur.

It is preferable if the support part is arranged in the position of use of the binding between the sole holders and with a spacing therebetween. With this measure, an undesired jamming of the support part with one or with both sole holders is prevented.

A further development consists in the support part being arranged on the pivot axis of the hold-down means.

A further construction consists in the support part being formed by two shafts arranged projecting from the underside of the hold-down means in direction of the base plate and being arranged both to one another and also in relationship to the two sole holders at a distance from each other. This construction can be designed in a simple manner by the shafts being screw bolts which are screwed into the underside of the hold-down means or pins which are inserted with a forced fit.

Furthermore it is preferable if the two shafts are connected for a pivotal movement through a limited range to the hold-down means and if one each shaft there is provided a holding support member with a curved surface, which holding support members prevent a working of the shaft into the ski boot sole. The size of the created frictional forces is additionally reduced by the curvature of the holding support member and the swingable support of the two shafts.

An additional measure to reduce the frictional forces consists in providing in a conventional manner an insert of a material which has a low frictional resistance, for example polytetrafluoroethylene (known under the trademark Teflon), on the support part or on the two holding supports.

All of the now-mentioned measures and characteristics are important for the invention.

BRIEF DESCRIPTION OF THE DRAWINGS

Further advantages, characteristics and details of the invention are described in more detail with reference to the drawings illustrating the examplary embodiments.

DETAILED DESCRIPTION

In the description which will now follow, only those structural parts of a common safety ski binding which are not important for the invention will not be described, but those parts which are necessary for a complete understanding of the inventive sole hold-down means will be described.

Figure 1:
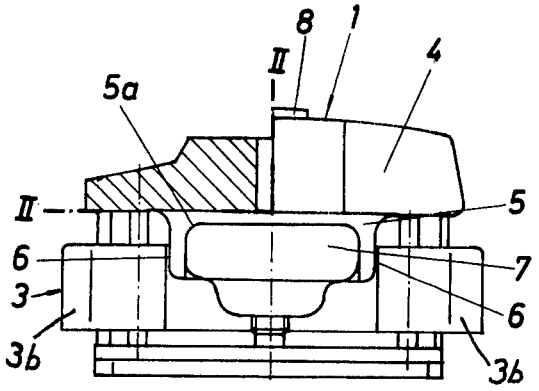
FIG. 1 is a side view of an inventive toe sole hold-down means in the normal position with the direction of view being toward the tip of the ski, partially sectioned along the line II—II of FIG. 2.
Figure 2:
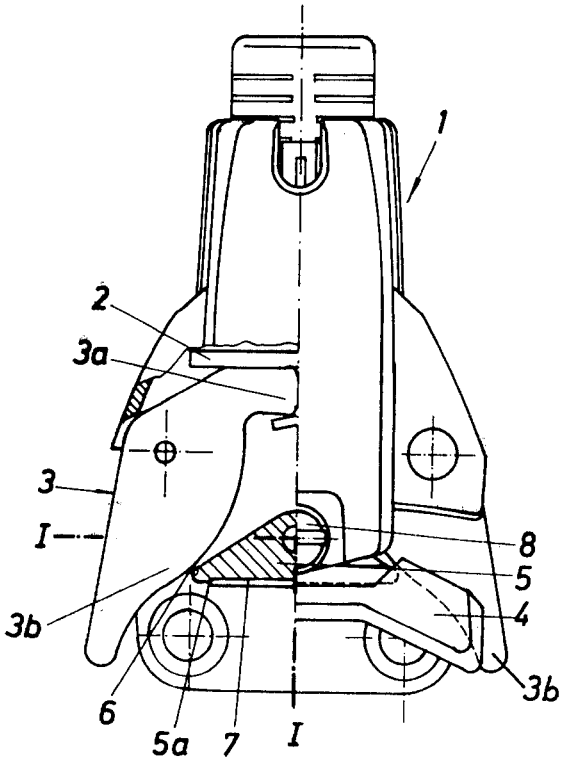
FIG. 2 is a top view of FIG. 1, partially sectioned along the line II—II of FIG. 1.
Figure 3:
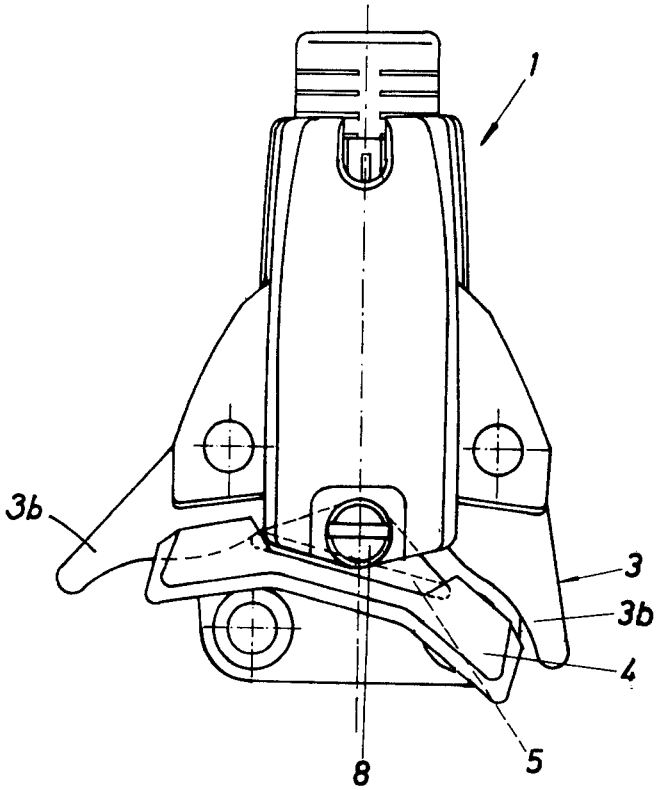
FIG. 3 is a top view of the inventive sole hold-down means in an operated or ski boot releasing position.

A safety ski binding 1 has, according to FIGS. 1 to 3, inside of it a stop plate 2, which is oriented substantially perpendicularly with respect to the longitudinal axis of the ski and vertically upright on a base plate of the binding. Lever arms 3*a* of sole holders 3, which are preferably designed as two-arm toggle levers, engage the stop plate 2 in the non-operated or ski boot holding position of the safety ski binding 1, since the lever arms 3*a* are in a conventional manner and here not discussed in detail, pulled by a spring-biassed pull rod in a direction toward the stop plate 2. For cross-reference purposes, reference can be made to U.S. Pat. No. 4,088,343.

A hold-down means 4 is pivotally secured to a binding housing in a conventional manner by an upstanding adjusting screw 8. The hold-down means has on its underside a support part 5. The width of the substantially rectangular support part 5 is chosen such that in the normal position of the safety ski binding 1, namely in the non-operated or ski boot holding position of the sole holders 3, there remains between same and the support part 5 a gap 6. The support part 5 has on the side which faces the not-illustrated ski boot a rectangular-shaped recess 5*a*, which serves to receive a small slide plate 7 therein having a low friction coefficient. The front edge of the sole of the not-illustrated ski boot rests in the normal position of the safety ski binding 1 on said small slide plate 7. The hold-down means 4 is thus centered by the ski boot itself and is held in the base or initial position.

If the safety ski binding 1 is free from a ski boot, for example during transport, then the hold-down means 4 is swingable only by an amount equal to the width of the two gaps 6.

During an arbitrary release of the safety ski binding 1, the two arm toggle lever or sole holder 3 on the side of the binding to which the release of the ski boot is to occur is swung in a direction outwardly away from the center of the ski. The spacing or rather the gap 6 is thereby increased on this one side, whereby the support part 5, which is swung together with the hold-down means 4, follows the sole holder 3 with a slight delay. The hold-down means 4 and support part 5 which are swung in the described manner permit the ski boot to lightly (i.e. without resistance) slide out of the safety ski binding 1. Subsequently, and after a release of the ski boot, the hold-down means 4 is swung in the opposite direction toward a base or initial position by the support part 5 engaged by the lever arm 3*b* of the two-arm toggle lever or sole holder 3 until the other lever arm 3*a* of the toggle lever or sole holder 3 rests on the stop plate 2. Also the return of the hold-down means 4 is thus done automatically and without the use of an additional return spring. The gap 6 which remains between the support part 5 and the toggle lever or the sole holder 3 permit, however, still, as above mentioned, a limited swinging of the hold-down means 4, which favors centering of the ski boot to be inserted.

Figure 4:
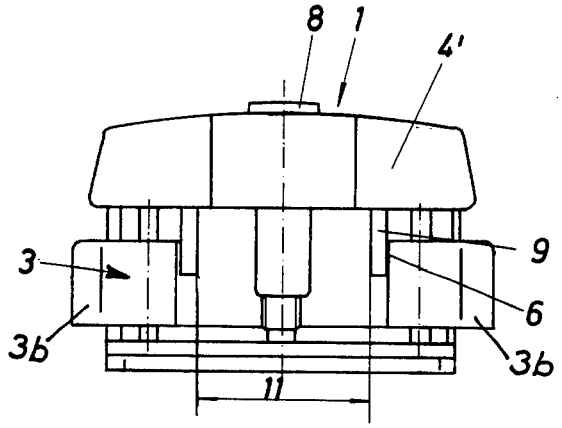
FIG. 4 is a second and FIGS. 5, 6*a* and 6*b* are a further exemplary embodiment similar to FIGS. 1 and 2 in side view and top view, respectively.

The exemplary embodiment according to FIG. 4 is designed but for the support part 5 just like the one according to FIGS. 1 to 3. In place of the support part 5, the hold-down means 4' carries on its underside two extensions 9, which are arranged at a distance 11 from one another. The extensions 9 are rigidly connected to the hold-down means 4'. In the nonoperated condition of the safety ski binding 1, there also remains a gap 6 between the extensions 9 and the toggle lever arms 3*b*.

Figure 5:
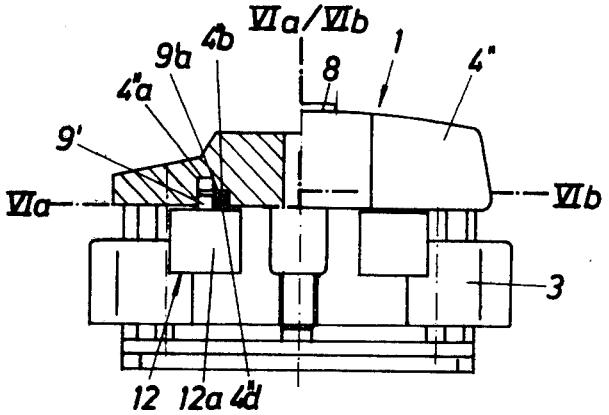
Figures 6A, 6B:
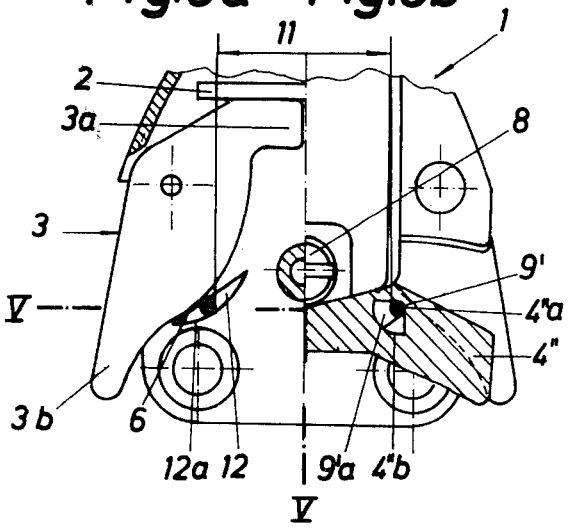

In the exemplary embodiment according to FIGS. 5, 6*a* and 6*b*, the hold-down means 4'' also carries two extensions 9'. The extensions 9' in this exemplary embodiment are arranged for a limited pivotal movement on the underside of the hold-down means 4''. The hold-down means 4'' has on its underside and on each side an opening 4''*a* spaced at a distance 11 from each other. The axes of the openings are positioned substantially perpendicularly to the upper side of a not-illustrated ski. Each of the two openings 4''*a* has starting approximately at the half depth thereof and extending approximately in direction of the underside of the hold-down means 4 a recess segment 4''*b* of larger cross-sectional area than the opening 4''*a*. The recess segment 4''*b* has approximately the shape of one-fourth of a disk.

The two openings 4''*a* each receive a part of a circular-shaped shaft 9'. A stop 9'*a* having the shape of a segment of a circle is secured to the shaft 9' and in cooperation with the recess 4''*b*, permits the shaft 9' to rotate only through a limited range. The shaft 9' is prevented from falling out by the recess 4''*b* being closed off by a closure piece 4''*d*, which only leaves the opening 4''*a* free. The shaft 9' has secured thereto on its part which is located outside of the hold-down means 4'' a holding support member 12. The holding support member 12 has a curved surface 12*a* on its side which faces the boot sole (not illustrated) to prevent a deformation working of the support member 12 into the material of the ski boot sole. The curvature of the curved surface 12*a* is directed opposite to the curvature of the front edge of the boot sole (not illustrated). The side which is remote from the curved surface 12*a* is flat. The surfaces on the holding support member 12 are oriented substantially perpendicularly to the upper surface of the ski (not illustrated).

In the normal position, namely in the nonoperated position of the safety ski binding 1, the holding support members 12 on the shafts 9' are positioned as illustrated in FIG. 6*a*. In order not to hinder a ski boot sole (not illustrated) during a release operation of the safety ski binding 1, the holding support members can undergo a rotative movement, as is illustrated in the cross-sectional view of FIG. 6*b*, about the axes of the shafts 9'. The left holding support member, viewed toward the tip of the ski, can rotate in the clockwise direction and the right holding support can rotate in the counterclockwise direction. The recess **4''*b* is, however, constructed such that in the normal position of each holding support member 12**, as is illustrated in FIG. 6*a* and 6*b*, there remains also a gap 6 between same and the associated toggle lever arms **3*b***.

According to a release operation, the hold-down means 4'' is centered by the sole holders 3 and the shafts 9' along with the holding support members 12 just as in the preceding exemplary embodiments. The inventive centering of the hold-down means is not limited to the illustrated exemplary embodiments. Further modifications are conceivable without departing from the scope of the invention. For example, it is possible to construct the support part or the shafts with the holding support members totally of a low friction material. In addition, it would also be possible to design the support members or the stops on the rotatable shafts differently.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding, comprising:

a binding housing mounted on the upper surface of a ski;

symmetrically arranged, two-arm sole holders pivotal between a sole holding position and a sole releasing position about ski-fixed axes which are arranged perpendicularly with respect to said upper surface and which each rest with one arm thereof against a side edge of the sole of a ski boot and a second arm thereof against one end of a resiliently biassed slide means whereby each of said sole holders is pivotal against the biassing force of said slide means, said resiliently biassed slide means effecting an urging of said sole holders toward said sole holding position;

sole hold-down means and pivotal support means for freely pivotally securing said sole hold-down means to said binding housing and for movement between first and second positions, said sole hold-down means having a downwardly facing surface adapted to engage an upwardly facing surface on said sole of said ski boot, said sole hold-down means further having an upright surface means adapted to engage a side edge of said sole of said ski boot and being movable with said sole hold-down means about said pivotal support means between said first and second positions therefor, said hold-down means being urged from said second position to said first position in response to at least one of said sole holders being urged by said resiliently biassed slide means from said sole releasing position to said sole holding position.

2. The safety ski binding according to claim 1, including means defining a clearance gap between each lateral edge of said upright surface means and each of said one arms of said sole holders whereby the range of free pivotal movement of said hold-down means is limited by the width of said gaps.

3. The safety ski binding according to claim 1 or 2, wherein said pivotal support means comprises an adjusting screw rotatably secured to said binding housing, said hold-down means being threadedly engaged with said screw to facilitate an adjusting of the vertical position of said hold-down means to accommodate different thicknesses of ski boot soles.

4. The safety ski binding according to claim 1 or 2, wherein said upright surface means includes two upstanding shafts projecting from the underside of said hold-down means in direction toward said upper surface of said ski and are laterally spaced both with respect to one another and also with respect to said sole holders.

5. The safety ski binding according to claim 4, wherein said shafts are at least one of screw bolts which are fixedly screwed into the underside of said hold-down means and pins which are inserted with a forced fit in an opening provided in the under surface of said hold-down means.

6. The safety ski binding according to claim 4, wherein said two shafts are rotatably connected to said hold-down means for a rotatable movement through a limited range, and wherein on each shaft there is arranged a holding support member having an enlarged curved surface, which holding support members prevent a deformation of said ski boot sole by said shafts.

7. The safety ski binding according to claim 1, wherein an insert of a material having a small frictional resistance is provide on said upright surface.

* * * * *